United States Patent [19]

Carrick

[11] 4,303,219

[45] Dec. 1, 1981

[54] SWIVEL-ROCKER BASE

[76] Inventor: Virgil P. Carrick, P.O. Box 867, High Point, N.C. 27261

[21] Appl. No.: 104,026

[22] Filed: Dec. 14, 1979

[51] Int. Cl.[3] ..... A47C 3/02

[52] U.S. Cl. ..... 248/425; 248/582; 248/596; 297/302

[58] Field of Search ..... 297/263, 261, 264, 265, 297/266, 302, 303, 304; 248/425, 372, 582, 596, 575–577

[56] References Cited

U.S. PATENT DOCUMENTS

| | | | |
|---|---|---|---|
| 452,686 | 5/1891 | Adams et al. | 248/596 |
| 2,584,184 | 2/1952 | Brown | 297/263 |
| 2,687,166 | 8/1954 | Hamilton | 297/303 |
| 2,973,026 | 2/1961 | Haaland | 297/302 |
| 3,300,244 | 1/1967 | Hughes | 297/261 |
| 3,333,811 | 8/1967 | Matthews | 297/264 X |
| 3,603,553 | 9/1971 | Doerner | 248/596 |
| 3,784,148 | 1/1974 | Hill | 248/582 |

*Primary Examiner*—Francis K. Zugel
*Attorney, Agent, or Firm*—Harvey B. Jacobson

[57] ABSTRACT

Upper and lower relatively rotatable members are provided with the upper member angularly displaceable relative to the lower member about an upstanding axis. The upper member includes first front and rear portions disposed forward and rearward of the axis and a seat amount is supported and projects upwardly from the upper member. A seat support member including second front and rear portions overlying the first front and rear portions is provided and is pivotally attached to the mount for oscillation about a horizontal transverse axis adjacent the upstanding axis. The seat support member may support a seat therefrom with the front and rear portions of the seat overlying the second front and rear upper member portions and expansion springs are connected and extend between the first and second front portions yieldingly resisting upward movement of the second front portion relative to the first front portion. Vertically adjustable upwardly facing abutment structure is carried by the first front portion and abuttingly engageable by the second front portion to limit downward swinging of the latter relative to the first front portion.

4 Claims, 2 Drawing Figures

SWIVEL-ROCKER BASE

BACKGROUND OF THE INVENTION

Various forms of rocker assemblies for swivelly and rockingingly supporting a seat structure from a base heretofore have been provided. Examples of these forms of previously known assemblies as well as other similar assemblies are disclosed in U.S. Pat. Nos. 1,362,042, 1,437,848, 2,132,291, 2,339,953, 3,070,342, 3,547,393, 3,840,205, 3,881,713 and 4,025,020.

However, these previously known forms of rocker assemblies and similar structures are, for the most part, complex in nature, expensive to produce and troublesome in operation. Accordingly, a need exists for an improved form of rocker assembly for swivelly and rockingly supporting a seat from a base.

SUMMARY OF THE INVENTION

The rocker assembly of the instant invention utilizes existing rotary support structure modified to oscillatably support a seat from one of the relatively rotatable components thereof in a manner limiting angular displacement of the seat in one direction and yieldingly resisting angular displacement of the seat in the opposite direction. The rotary support structure comprises a conventional rotary base assembly including relatively rotatable upper and lower plates and the lower plate is supported from a stationary base while the upper plate has a seat support member oscillatably supported therefrom for angular displacement about a horizontal axis and from which the associated seat is supported. The seat support member and upper plate include corresponding front portions between which expansion spring structure is connected to limit upward swinging movement of the forward end of the seat support member relative to the forward portion of the upper plate and the seat support member and upper plate include coacting abutment structure for limiting downward swinging movement of the forward end of the seat support member relative to the upper plate.

The main object of this invention is to provide a rocker assembly for swivelly and rockingly supporting a seat structure from a base.

Another object of this invention is to provide a rocker assembly including readily available components which may be assembled by simple manufacturing methods to form an effective rocker assembly.

Still another important object of this invention is to provide a rocker assembly which may be utilized in conjunction with many different forms of seat and seat bases relative to which the seat is to be rockably and swivelly supported.

A final object of this invention to be specifically enumerated herein is to provide a rocker assembly in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
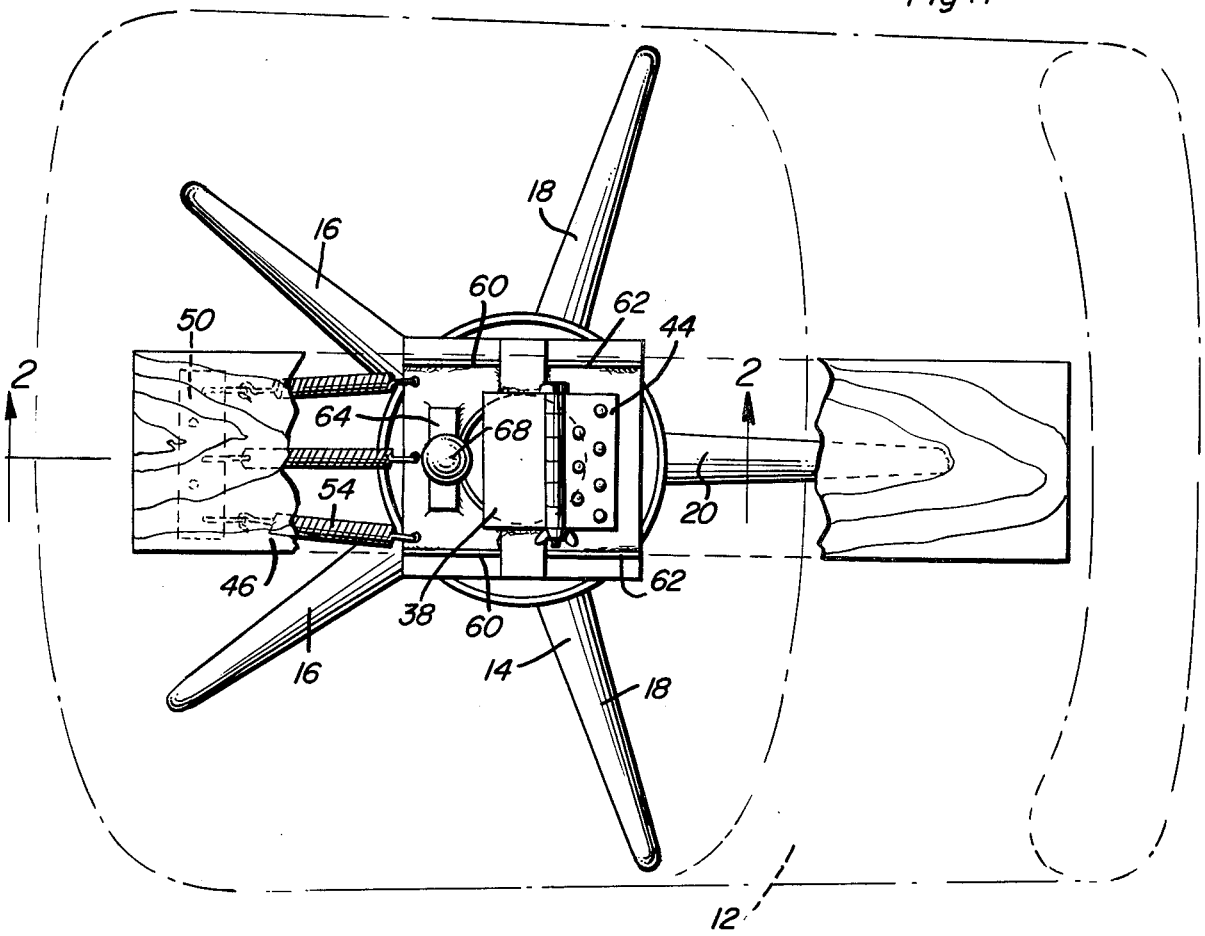
FIG. 1 is a fragmentary top plan view of a seat support assembly incorporating the rocker assembly of the instant invention therein and with a portion of the seat support member of the rocker assembly being broken away.

Referring now more specifically to the drawings, the numeral 10 generally designates a rocker assembly upon which a seat 12 is mounted for rockably and swivelly supporting the seat 12 from a base 14.

The base 14 comprises a plurality of interconnected inclined legs 16, 18 and 20 arranged in a radiating pattern projecting outwardly from a central area of the base 14 and the assembly 10 includes upper and lower relatively rotatable members 22 and 24. The lower member 24 is generally circular in plan shape and is secured, by fasteners 26, at points spaced about its periphery to the legs 16, 18 and 20. A bearing assembly 28 rotatably supports the outer periphery of the upper plate or member 22 from the outer periphery of the lower member or plate 24 and an inner bearing assembly 30 rotatably supports the inner periphery of the lower plate or member 24 from the inner periphery of the upper plate 22, the latter being generally square in plan shape.

The upper plate 22 includes a front portion 30 disposed forward of the upstanding axis of relative oscillation of the plates 22 and 24 and a rear portion 32 disposed rearwardly of the axis.

Figure 2:
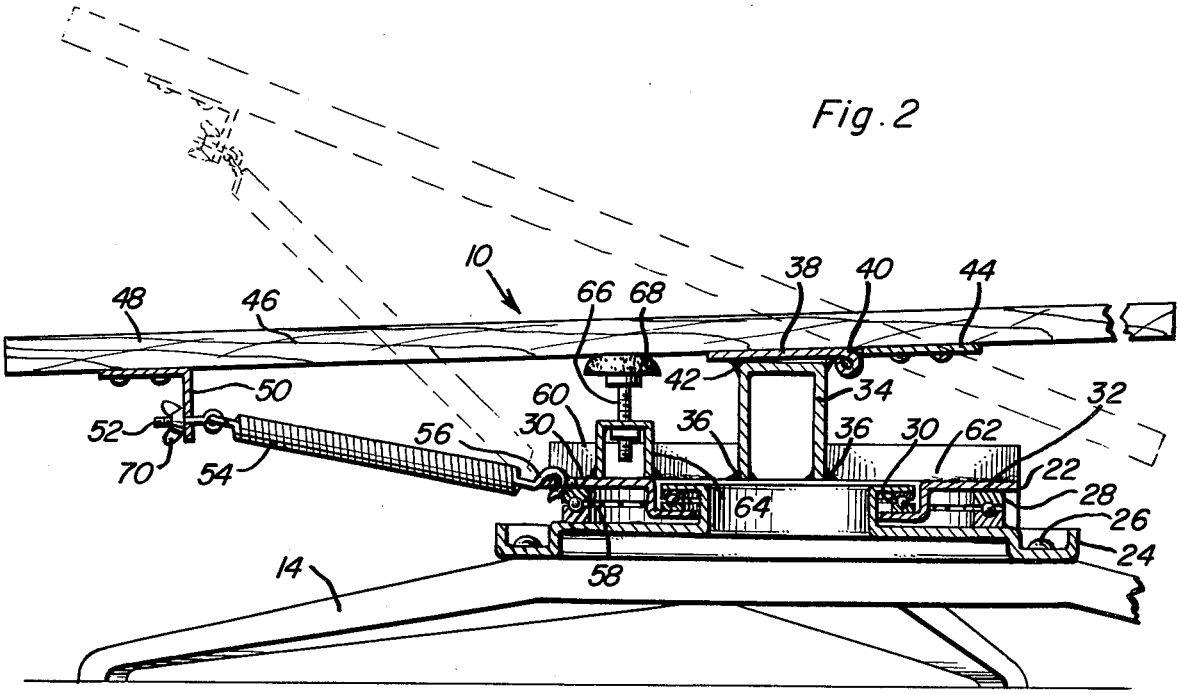
FIG. 2 is a fragmentary enlarged vertical sectional view taken substantially upon the plane indicated by the section line 2—2 of FIG. 1.

The upper plate 22 has an inverted transversely extending U-shaped channel member 34 secured thereto by welding 36 and one leaf 38 of a hinge assembly 40 is secured by welding 42 to the upper surface of the inverted channel member 34. The other leaf 44 of the hinge assembly 40 is secured to the underside of an elongated front to rear extending seat support member 46 including a front portion 48 from which an anchor bracket 50 is dependingly supported. A plurality of spring anchors 52 are adjustably supported from the bracket 50 and have corresponding ends of a plurality of expansion springs 54 anchored relative thereto. The other ends of the expansion springs 54 are hooked as at 56 and engaged in apertures 58 provided therefor in the front portion 30 of the upper plate or member 22. The springs 54 are forwardly and upwardly inclined at a shallow angle of less than 45° when the seat support member 46 is in the generally horizontal position thereof illustrated in solid lines in FIG. 2.

The opposite ends of the channel member 36 are braced relative to the corresponding side of the upper plate 22 by front and rear edge upstanding bracing plates 60 and 62 secured to ther upper plate 22 and to the corresponding front and rear sides of the channel member 34 at the opposite end portions thereof.

Further, a second inverted channel member 64 is secured by welding to the front portion 30 of the upper plate 22 between the bracing plates 60 and adjustably supports the threaded shank 66 of an upwardly facing resilient abutment 68 therefrom.

The springs 54 yieldingly resist upward swinging movement of the forward portion 48 of the seat support member 46 relative to the forward portion 30 of the upper plate 22 and the abutment 68 limits downward swinging movement of the forward portion 48 of the seat support member 46 relative to the upper plate 22. The seat 12 is secured in any convenient manner to the seat support member 46.

If it is desired, one or more rear springs corresponding to the springs 54 may be secured between the rear portion 32 of the upper plate 22 and the rear portion of the seat support member 46 in a manner similar to the manner in which the springs 54 are connected between the front portion 30 and the bracket 50. Also, although the pivot axis of relative oscillation between the hinge leafs 38 and 44 is disposed slightly rearward of the axis of relative oscillation of the plates 22 and 24, the hinge axis may be spaced slightly forward of the position thereof illustrated in FIG. 2 in order to be more closely spaced relative to the upstanding axis of relative oscillation of the plates 22 and 24. However, the hinge axis is preferably spaced approximately 1¼ inches rearward of the axis of relative oscillation of the plates 22 and 24.

The anchors 52 may be adjusted in a front to rear direction relative to the seat support member 46 through the utilization of the threaded thumb screws 70 by which the anchors 52 are supported from the bracket 50 and, thus, the tension of the springs 54 may be adjusted as desired, independently.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A rocker support assembly for swivel and rocking support of a seat structure, said assembly including a roller member for anchoring atop a stationary base, an upper member disposed over and rotatably supported from said lower member for angular displacement relative thereto about an upstanding axis, said upper member including first front and rear portions disposed forward and rearward, respectively, of said axis, a seat support means mounted on and projecting upwardly from said upper member, a seat support member including second front and rear portions overlying said first front and rear portions, pivotally attached to said mount for oscillation about a horizontal transverse axis adjacent said upstanding axis and extending forwardly and rearwardly of said transverse axis, said seat support member being adapted to support a seat therefrom with front and rear portions of said seat overlying said second front and rear portions, expansion spring means connected and extending between said first and second front portions yieldingly resisting upward movement of said second front portion relative to said first front portion, vertically adjustable upwardly facing abutment structure carried by said first front portion and abuttingly engageable by said second front portion to limit downward swinging of the latter relative to said first front portion, said expansion spring means comprising a plurality of elongated inclined coiled expansion springs having their lower ends anchored to said first front portion and their upper ends anchored to said second front portion, said expansion springs being forwardly and upwardly inclined when said second portion is downwardly abutted against said abutment structure.

2. The combination of claim 1 wherein said seat support mount comprises a horizontal transverse inverted channel member secured to and extending across said upper member, a hinge construction having a first leaf thereof anchored relative to the central upper surface portion of said inverted channel member and a second leaf thereof anchored relative to said seat support member.

3. The combination of claim 2 wheren said first and second leaves are pivotally connected together and define said horizontal transverse axis, said horizontal transverse axis being disposed rearward of said inverted channel-shaped member.

4. The combination of claim 1 including anchor means anchoring said upper forward ends of said expansion springs to said second front portion for independent tension adjustment of said springs.

* * * * *